US005216824A

United States Patent [19]

Blissett et al.

[11] Patent Number: 5,216,824

[45] Date of Patent: Jun. 8, 1993

[54] SHOE CONSTRUCTION

[75] Inventors: Malcolm G. Blissett, Grand Rapids; Raymond M. Fredericksen, Okemos, both of Mich.

[73] Assignee: Wolverine World Wide, Inc., Rockford, Mich.

[21] Appl. No.: 519,592

[22] Filed: May 7, 1990

[51] Int. Cl.[5] ..... A43B 13/18

[52] U.S. Cl. ..... 36/28; 36/25 R; 36/32 R

[58] Field of Search ..... 36/28, 25 R, 32 R, 114, 36/59 R, 59 C, 27, 7.8, 35 R

[56] References Cited

U.S. PATENT DOCUMENTS

| | | | |
|---|---|---|---|
| 1,945,115 | 1/1934 | Leggee . | |
| 1,972,843 | 9/1934 | Hubbard | 36/32 R |
| 1,984,989 | 12/1934 | Reed . | |
| 2,055,574 | 9/1936 | Hartl . | |
| 2,394,281 | 2/1946 | Williams | 36/35 R |
| 2,551,885 | 5/1951 | Johnson | 36/32 R |
| 2,629,189 | 2/1953 | Stein . | |
| 2,930,149 | 3/1960 | Hack et al. | 36/28 |
| 2,937,462 | 5/1960 | Hack et al. | 36/59 C |
| 3,006,085 | 10/1961 | Bingham, Jr. | 36/59 C |
| 3,196,561 | 7/1965 | Champion | 36/35 R |
| 4,030,213 | 6/1977 | Daswick . | |
| 4,041,619 | 8/1977 | Sapper . | |
| 4,237,625 | 12/1980 | Cole et al. . | |
| 4,262,433 | 4/1981 | Hagg et al. . | |
| 4,352,902 | 11/1982 | Cole et al. . | |
| 4,372,059 | 2/1983 | Ambrose . | |
| 4,577,417 | 3/1986 | Cole . | |
| 4,676,010 | 6/1987 | Cheskin | 36/114 |
| 4,747,219 | 5/1988 | Ammendolea . | |
| 4,852,273 | 8/1989 | Hamy . | |
| 4,858,338 | 8/1989 | Schmid . | |
| 4,956,927 | 9/1990 | Misevich et al. | 36/32 R |

FOREIGN PATENT DOCUMENTS

| | | | |
|---|---|---|---|
| 0185781 | 7/1986 | European Pat. Off. | 36/25 R |
| 0112804 | 7/1982 | Japan | 36/25 R |
| 304 | of 1876 | United Kingdom | 36/28 |

OTHER PUBLICATIONS

Nawoczenski, "Effect of Rocker Sole Design on Plantar Forefoot Pressures", *Journal of the American Podiatric Medical Association*, vol. 78, No. 9, Sep. 1988, pp. 455–460.

*Primary Examiner*—Steven N. Meyers
*Attorney, Agent, or Firm*—Price, Heneveld, Cooper, DeWitt & Litton

[57] ABSTRACT

A walking shoe and walking shoe sole with the sole heel portion and forefoot portion having integral resilient flexible compression protrusions having maximum extension at the rear edge of the protrusion, curving upwardly forwardly therefrom, and bounded by a groove that extends along both side edges and across the rear vertically offset edge of the protrusion, the groove increasing in depth toward the rear of the protrusion. The rear of at least the forefoot protrusion is undercut. The upper surface of the sole has at least one transverse cavity just forwardly of the rear edge of the protrusion.

11 Claims, 3 Drawing Sheets

SHOE CONSTRUCTION

BACKGROUND OF THE INVENTION

This invention relates to walking shoes and particularly to a walking shoe and shoe sole exhibiting superior shock attenuating characteristics and more efficient toeoff.

Walking shoes of various styles and constructions have been made over the decades, but in recent years the increased interest in energetic walking for cardiovascular health has stimulated efforts to improve walking shoe comfort and action. These two factors of comfort and shoe action have a significant effect on the attitude and willingness of walkers to continue in this beneficial activity. These two different factors do not normally arise from the same construction.

SUMMARY OF THE INVENTION

An object of this invention is to provide a unique walking shoe which effects excellent comfort as well as improved propulsive action. Force platform measurements of the biomechanical actions show improved shock attenuation and greater toeoff efficiency. Consequently, the walking shoes are more comfortable and effect improved action.

The shoe sole is formed of a resilient rubber type material having a general sole level defined by a peripheral marginal ledge portion, having a uniquely curved, offset and isolated, integral compression protrusion on the heel portion of the sole and a similarly curved, offset and isolated, integral compression protrusion on the forefoot. The maximum downward extension of the forefoot protrusion is behind the metatarsal heads, the protrusion curving forwardly upwardly from a vertically offset rear edge toward the level of the sole. The compression protrusions are each bounded by a deep groove to isolate and allow the vertical movement therebetween. The rear edge of at least the forefoot protrusion has a rear overhang, i.e., is undercut at the rear edge.

The heel protrusion, like the sole protrusion, has the maximum downward protrusion at the rear edge, curving upwardly forwardly from the vertically offset rear edge toward the front of said heel.

Upon impact the maximum protrusion portion of the heel is compressed into the sole absorbing shock impact. With forward movement of the foot through the gait cycle, the compressed rear portion of the protrusion on the heel reverts back to its original position to propel the rear of the foot forwardly and upwardly, while the rear portion of the forefoot protrusion is compressed into the sole. Further advancement of the foot through the gait cycle causes the rear portion of the forefoot protrusion to revert, i.e., re-extend, which, combined with the rolling action over the curved protrusion, causes rapid toeoff of the foot. The result is efficient toeoff, as has been illustrated from vertical ground reaction force plots taken of persons wearing the novel shoe and walking across a force platform.

DESCRIPTION OF THE PREFERRED EMBODIMENT

Figure 1:
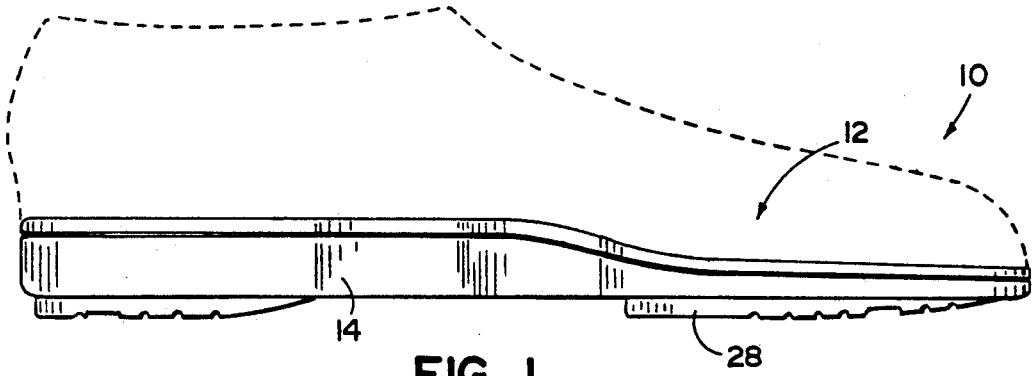
FIG. 1 is a side elevational view of the lateral side, i.e., outside, of a right foot walking shoe employing this invention and showing the shoe upper in phantom lines.
Figure 2:
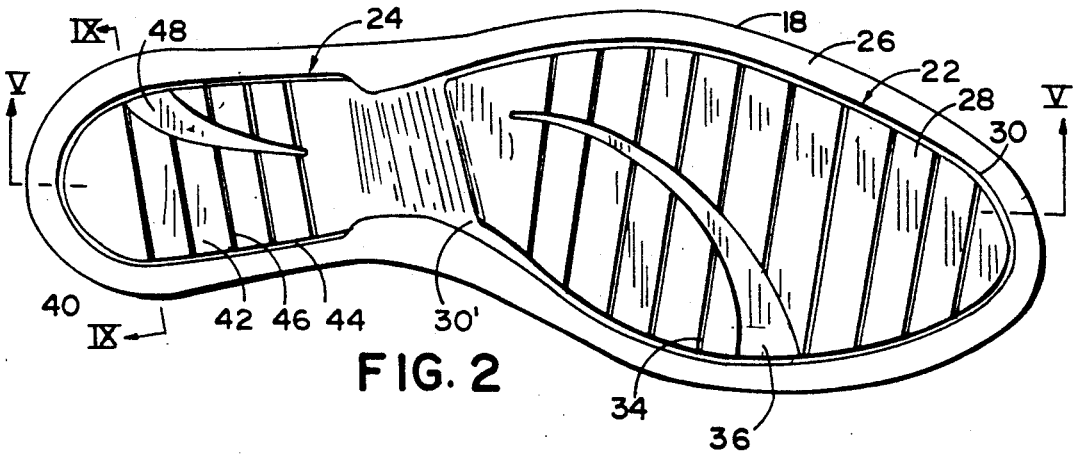
FIG. 2 is a bottom view of the walking shoe in FIG. 1.

Referring now specifically to the preferred embodiment illustrated in the drawings, the walking shoe 10 there disclosed includes an upper subassembly 12 as of conventional type and a sole subassembly 14. This sole comprises a resilient, flexible, compressible, polymeric material, preferably low density, microcellular, i.e., foam type polyether polyurethane, having a durable skin. Such a material has been found to exhibit effective compressive action with excellent rebound in the form of the invention. Alternative materials would include other polymers such as expanded polyesters commonly used for shoe soles, foam rubber compounds and the like. The sole includes an upper surface 16, a periphery 18, and a lower sole level 20. The sole has a forefoot portion 22 and a heel portion 24.

Figure 5:
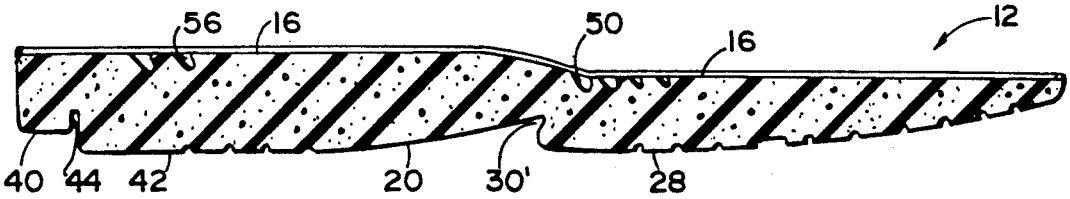
FIG. 5 is a cross sectional view taken on plane V—V of FIG. 2.
Figure 6:
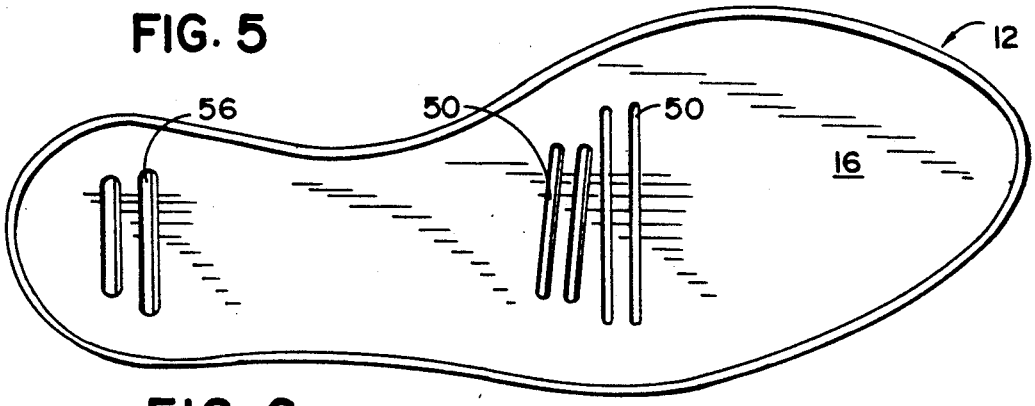
FIG. 6 is a top plan view of the sole.
Figure 3:
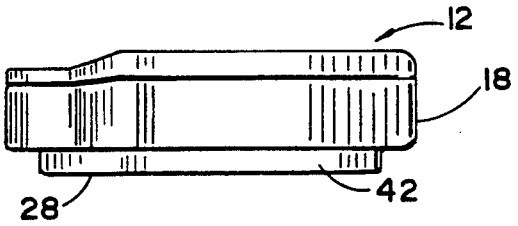
FIG. 3 is a rear elevational view of the shoe sole in FIGS. 1 and 2.
Figure 4:
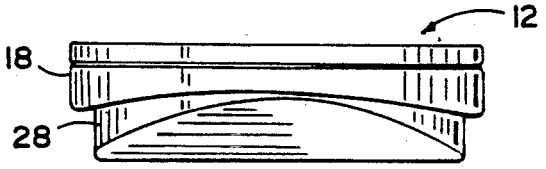
FIG. 4 is a front elevational view of the shoe sole.

The forefoot portion 22 includes a peripheral marginal ledge 26 and an integral compression protrusion 28 extending downwardly beneath the level of the marginal ledge. The maximum extension of this protrusion 28 is at the rear thereof, causing a vertical offset relative to the plane of ledge 26, the protrusion curving upwardly forwardly from the rear to blend to the plane of marginal ledge 26 at the toe. At this area, the protrusion extends down below the level of the ledge about 3/16 inch. The curvature of protrusion 28 upwardly forwardly thus forms a gently curved sloping surface. Extending around protrusion 28, isolating it from marginal ledge 26, is a deep groove 30 which includes a transverse groove portion 30' along the rear edge of the protrusion. The groove is progressively deeper from the toe area along the side edges toward the rear of the protrusion, and is deepest across the rear edge of protrusion 28 on the forefoot. The groove preferably starts at a depth of about 1/16 inch at the toe and deepens to about 3/16 inch above the ledge at the sides adjacent the rear edge of the protrusion. Groove portion 30' undercuts the rear edge of protrusion 28 (FIG. 5) such that the rear portion of the protrusion overhangs the groove to form a lip 28' (FIG. 5). This offset rear edge lip is to the rear of the metatarsal heads for proper action of the shoe, and at an angle substantially parallel to the metatarsal break M of the foot, i.e., a line between the second and fifth metatarsal heads. This angle is about 60° to the center line of the shoe. The bottom surface of the sole curves into groove portion 30' (see FIG. 5). Groove 30 extends upwardly into the sole above the level of ledge 26. This groove effectively isolates the vertical action of protrusion 28 from peripheral ledge 26, in a manner to be described more fully hereinafter. The bottom surface of protrusion 28 preferably has a series of shallow, generally transverse slots 34 and a decorative arcuate recess 36.

The heel portion of the shoe also has a peripheral marginal ledge 40 extending around a protrusion 42. A groove 44 extends around both sides and the rear of protrusion 42. Groove 44 extends upwardly into the sole above the level of peripheral ledge 40. Groove 44 is progressively deeper from the front of the heel portion (about 1/16 inch) rearwardly to the deepest portion around the rear of the heel (about 3/16 inch). The maximum extension of the heel protrusion 42, preferably about 3/16 inch, is at the very rear thereof, forming a vertical offset, sloping from there in an upwardly forwardly curving fashion to the level of marginal ledge 40. Groove 44 thus substantially isolates the vertical action of protrusion 42 from peripheral ledge 40, as more fully explained hereinafter. The bottom surface of protrusion 42 preferably has a plurality of transverse shallow slots 46 and an arcuate fanciful recess 48 extending out to the lateral side of the protrusion for traction.

The upper surface of sole subassembly 14 preferably has at least one, and here shown to be four, transverse cavities 50 just forwardly of the maximum extension of protrusion 28. Also in the top surface of the sole, just forwardly of the maximum extension of protrusion 42, is at least one, here shown to be two, transverse cavities 56. These cavities provide space for furthering the vertical compressive activity of the polymeric sole upwardly in a manner to be more fully described hereinafter.

The lower surfaces of protrusions 28 and 42 are preferably in substantially the same horizontal plane at the deepest, i.e., maximum rear, extension of these protrusions. The upper surface of the heel portion of the sole subassembly is preferably at a higher elevation than the forefoot portion.

Figure 7:
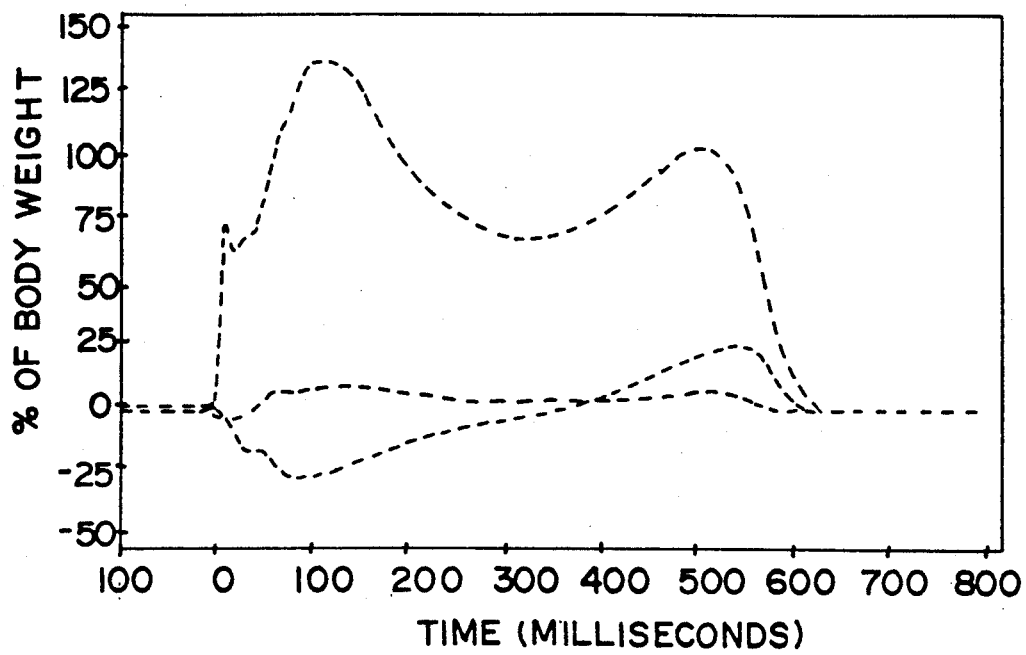
FIG. 7 is a force plot of stocking bearing foot of a person walking across a force platform.
Figure 8:
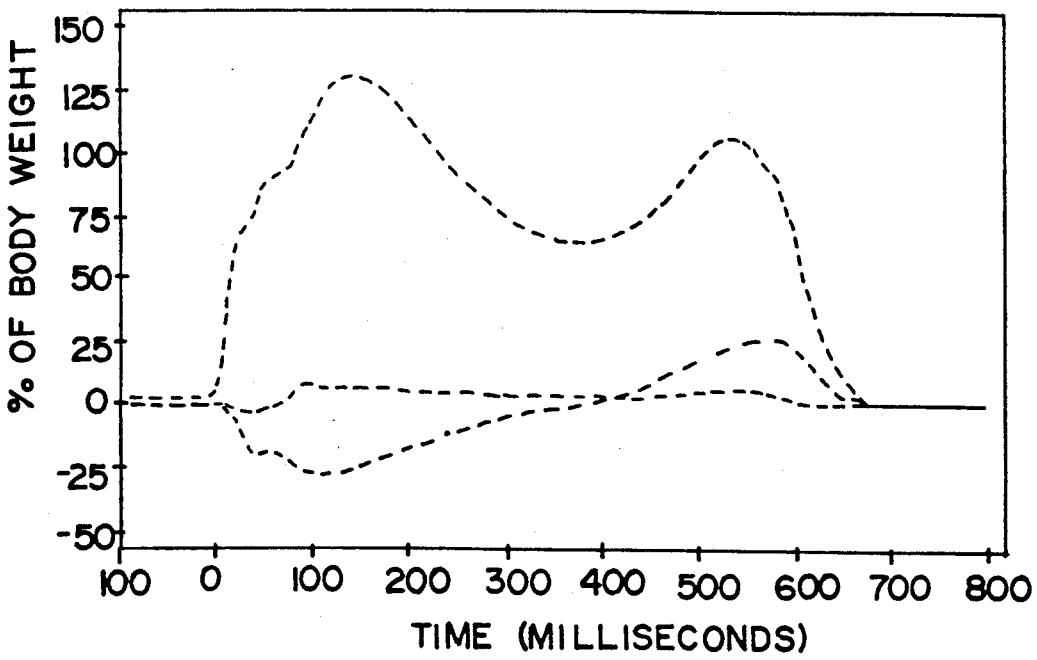
FIG. 8 is a force plot of the person wearing a shoe of the novel construction and walking across the force platform.

The reaction forces, as analyzed on a force platform in a biomechanics evaluation laboratory at a state university, have shown that the structure has excellent shock attenuation and toeoff efficiency. Referring to the force plots in FIGS. 7 and 8, a comparison is shown between the walker with stocking feet (FIG. 7) and with the novel shoe (FIG. 8) for illustration purposes. The horizontal axis is time in milliseconds in these figures, while the vertical axis is in percentage of body weight. The longer curve portrays the vertical ground reaction force, the somewhat sinusoidal curve portrays the braking and propulsive force, and the smallest curve represents the lateral to medial force, all three curves being superimposed on each other. In FIG. 7, the initial sharp impact force experienced by the heel shows as a spike at the left end of the vertical force curve. The absence of this initial force spike at foot contact (see FIG. 8) using the novel structure indicates that the force is advantageously dissipated over a greater period of time. Secondly, the novel shoe evidences a highly efficient toeoff indicated by the level of the toeoff curve (the second peak of the vertical force curve) being as low as that for stocking feet, rather than being considerably higher as might be anticipated, meaning that less force is required during the propulsion phase of the gait. This reduces stress and muscle fatigue. These are highly desirable traits of a shoe since fatigue and injury are often attributed to the high rates of load initially applied, and the effort required for toeoff when wearing shoes. The novel design indicates synergistic function with the natural biomechanism of the foot in attenuating ground reaction forces associated with impact and effecting toeoff efficiency by reducing the amount of force necessary to propel the body forward.

Figure 9:
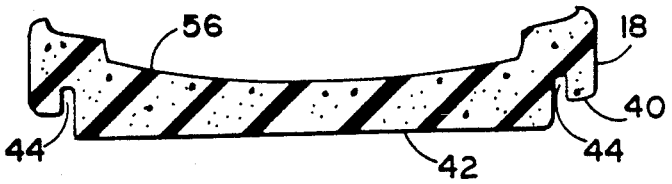
FIG. 9 is a diagrammatic cross sectional view of the sole taken transversely across the heel portion at plane IX—IX.
Figure 10:
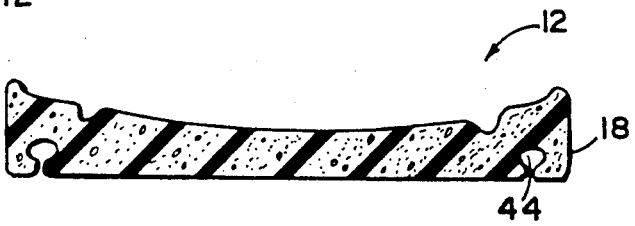
FIG. 10 is a diagrammatic cross sectional view of the sole in FIG. 9 but distorted under compressive load.
Figure 11:
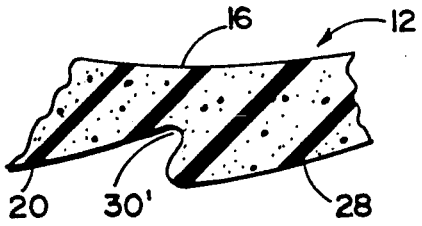
FIG. 11 is a fragmentary diagrammatic cross sectional view of the rear portion of the forefoot protrusion and adjacent undercut groove showing the overhang.
Figure 12:
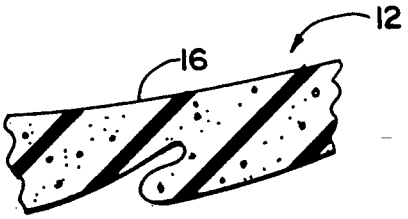
FIG. 12 is a fragmentary diagrammatic view comparable to FIG. 11 but distorted under compressive load.

The full technical explanation of the action of the shoe sole may not be known. It is believed that the following may be at least a partial explanation of the action. The attenuation of shock is believed aided by the fact that the initial impact of the heel region is at the maximum extension of protrusion 42, causing this protrusion to be compressed up into the sole, with groove 44 there being the deepest, allowing this protrusion to move vertically substantially independently of peripheral ledge 40, and also to distort and accommodate the shifting protrusion. Referring to FIGS. 9-12, FIG. 9 illustrates the sole cross section at the rear of the heel protrusion, prior to ground engagement. Upon impact (FIG. 10) protrusion 42 is forced upwardly with the cellular polymer being compressed, groove 44 being distorted, some of the protrusion shifting into recesses 56, and even ledge 40 sometimes being slightly distorted under compression. The vertically offset rear edge of protrusion 42 tends to distort rearwardly-upwardly, approaching or reaching the level of ledge 40. The foot then rocks forwardly on the upwardly, forwardly curving protrusion. As weight is removed from the rear portion of protrusion 42, it resiliently reverts to its original extended position by reason of its inherent memory, returning energy to the walker. Further movement of the foot in the next stage of the gait causes the rear downwardly extending protrusion of the forefoot protrusion 28 to engage the surface and, as weight is shifted, the maximum extension rear lip portion 28' of protrusion 28 (FIG. 11) is compressed up into the undercut (FIG. 12) and also into the sole in the same manner as illustrated by FIGS. 9 and 10. Groove 30 allows this to occur substantially independent of the surrounding peripheral ledge 26. Further movement of the body weight onto the metatarsal heads and then onto the great toe results in the foot gently rocking forwardly on the upwardly, forwardly sloping curvilinear portion of protrusion 28, with the rear compressed portion of the protrusion resiliently returning to its original position to thereby restore energy to the walker as toeoff from the great toe occurs. There may be other physical actions and biomechanics occurring which are not fully understood.

It is conceivable that certain minor deviations of the construction illustrated as the preferred embodiment of the invention could be made to accommodate particular types of situations or personal biomechanics. Hence, the invention is not intended to be limited specifically to the illustrative embodiment set forth, but only by the scope of the appended claims and the reasonably equivalent structures to those defined therein.

The embodiments of the invention in which an exclusive property or privilege is claimed are defined as follows:

1. A walking shoe comprising:

a sole and an upper connected thereto;

said sole comprising a resilient, flexible, compressible rubber type material defining an upper surface, a periphery and a lower sole level;

said sole having a forefoot portion and a heel portion;

said forefoot portion and said heel portion each having a peripheral marginal ledge defining a general sole level, and an integral compression protrusion extending downwardly beneath the level of said marginal ledge;

the maximum extension of each said compression protrusion being at the rear of said protrusion, and each said protrusion curving upwardly forwardly from said rear;

said protrusion maximum extension at said heel portion being positioned relative to said marginal ledge to receive initial impact during walking; and a groove bounding and isolating each said protrusion, said groove extending up into said sole above the level of said marginal ledge.

2. The walking shoe in claim 1 wherein each said compression protrusion has side edges and a rear edge;

said rear edge of said protrusion having a vertical offset, and said groove extending along said side edges and said rear edge.

3. The walking shoe in claim 2 wherein said rear of said protrusion in said forefoot portion has an undercut.

4. The walking shoe in claim 2 wherein said groove is progressively deeper along said side edges toward the rear of said protrusion and is deepest at the rear of said compression protrusion.

5. The walking shoe in claim 1 wherein said upper surface has at least one transverse cavity just forwardly of each said maximum extension.

6. The walking shoe in claim 1 wherein said rear of said protrusions are in substantially the same horizontal plane.

7. The walking shoe in claim 1 wherein said rear edge of said forefoot portion protrusion is to the rear of the metatarsal heads and at an angle generally parallel to the metatarsal break line.

8. A walking shoe sole comprising:

said sole comprising a resilient, flexible, compressible rubber type material defining an upper surface, a periphery and a lower sole level;

said sole having a forefoot portion and a heel portion;

said forefoot portion and said heel portion each having a peripheral marginal ledge defining a general sole level, and an integral compression protrusion extending downwardly beneath the level of said marginal ledge;

the maximum extension of each said compression protrusion being at the rear of said protrusion, and each said protrusion curving upwardly forwardly from said rear;

said protrusion maximum extension at said heel portion being positioned relative to said marginal ledge to receive initial impact during walking; and a groove bounding and isolating each said protrusion, said groove extending up into said sole above the level of said marginal ledge.

9. The walking shoe sole in claim 8 wherein each said compression protrusion has side edges and a rear edge;

said rear edge of said protrusion having a vertical offset, and said groove extending along said side edges and said rear edge.

10. The walking shoe sole in claim 9 wherein said rear of said protrusion in said forefoot portion has an undercut.

11. The walking shoe in claim 9 wherein said groove is progressively deeper along said side edges toward the rear of said protrusion and is deepest at the rear of said compression protrusion.

* * * * *